US012799423B2

(12) United States Patent
Hüttner et al.

(10) Patent No.: US 12,799,423 B2
(45) Date of Patent: Nov. 17, 2026

(54) USE OF A LUBRICANT COMPOSITION FOR LUBRICATING WORK TOOL

(71) Applicant: Klueber Lubrication Muenchen GmbH & Co. KG, Munich (DE)

(72) Inventors: Sarah Hüttner, Weilheim (DE); Dirk Loderer, Gilching (DE); Jan Robert, Munich (DE); Stefan Seemeyer, Wolfratshausen (DE)

(73) Assignee: KLUEBER LUBRICATION MUENCHEN GMBH & CO. KG, Munich (DE)

( * ) Notice: Subject to any disclaimer, the term of this patent is extended or adjusted under 35 U.S.C. 154(b) by 0 days.

(21) Appl. No.: 18/850,583

(22) PCT Filed: Nov. 9, 2022

(86) PCT No.: PCT/EP2022/081271

§ 371 (c)(1),
(2) Date: Sep. 25, 2024

(87) PCT Pub. No.: WO2023/179897

PCT Pub. Date: Sep. 28, 2023

(65) Prior Publication Data

US 2025/0215349 A1 Jul. 3, 2025

(30) Foreign Application Priority Data

Mar. 25, 2022 (EP) ..... 22164549

(51) Int. Cl.

| | |
|---|---|
| ***C10M 169/02*** | (2006.01) |
| ***C10M 105/32*** | (2006.01) |
| ***C10M 107/08*** | (2006.01) |
| ***C10M 111/04*** | (2006.01) |
| ***C10M 117/04*** | (2006.01) |
| *C10N 20/02* | (2006.01) |
| *C10N 20/04* | (2006.01) |
| *C10N 30/00* | (2006.01) |
| *C10N 40/00* | (2006.01) |

(52) U.S. Cl.

CPC ..... *C10M 169/02* (2013.01); *C10M 105/32* (2013.01); *C10M 107/08* (2013.01); *C10M 111/04* (2013.01); *C10M 117/04* (2013.01); *C10M 2205/0206* (2013.01); *C10M 2205/0265* (2013.01); *C10M 2207/1285* (2013.01); *C10M 2207/2805* (2013.01); *C10N 2020/02* (2013.01); *C10N 2020/04* (2013.01); *C10N 2030/44* (2020.05); *C10N 2040/38* (2020.05)

(58) Field of Classification Search

CPC ..... C10M 169/02; C10M 105/32; C10M 107/08; C10M 111/04; C10M 117/04; C10M 2205/0206; C10M 2205/0265; C10M 2207/1285; C10M 2207/2805; C10M 2201/061; C10M 2201/062; C10M 2201/085; C10M 2201/1026; C10M 2201/1056; C10M 2203/065; C10M 2203/1006; C10M 2205/0225; C10M 2205/026; C10M 2205/0285; C10M 2207/0406; C10M 2207/1236; C10M 2207/1265; C10M 2207/127; C10M 2207/1276; C10M 2207/1426; C10M 2207/1446; C10M 2207/285; C10M 2207/401; C10M 2209/1033; C10M 2213/0606; C10M 2213/062; C10M 2215/1026; C10M 2229/025; C10M 169/06; C10N 2020/02; C10N 2020/04; C10N 2030/44; C10N 2040/38; C10N 2010/02; C10N 2010/04; C10N 2010/06; C10N 2030/06; C10N 2030/08; C10N 2030/36; C10N 2030/62; C10N 2030/68; C10N 2030/74; C10N 2040/02; C10N 2040/046; C10N 2040/06; C10N 2040/50; C10N 2050/10; C10N 2070/00

See application file for complete search history.

(56) References Cited

U.S. PATENT DOCUMENTS

| | | | |
|---|---|---|---|
| 2013/0012416 A1 | 1/2013 | Fujinami et al. | |
| 2017/0321143 A1 | 11/2017 | Egersdorfer et al. | |
| 2020/0157454 A1* | 5/2020 | Seemeyer | C10M 155/02 |
| 2020/0332215 A1 | 10/2020 | Sawaguchi | |

FOREIGN PATENT DOCUMENTS

| | | | |
|---|---|---|---|
| CN | 107955694 A | | 4/2018 |
| CN | 107987943 A | | 5/2018 |
| CN | 110157525 | * | 8/2019 |
| DE | 102005013266 A1 | | 9/2006 |
| EP | 2554644 A1 | | 2/2013 |
| EP | 3375850 A1 | | 9/2018 |

(Continued)

OTHER PUBLICATIONS

Extract of IN 201821017762 A.

*Primary Examiner* — Cephia D Toomer
(74) *Attorney, Agent, or Firm* — LEYDIG, VOIT & MAYER, LTD.

(57) ABSTRACT

A method for lubricating a work tool, including providing a lubricant composition, the lubricant composition including 72 wt. % to 95 wt. % polyalphaolefin and 5 wt. % to 28 wt. % lithium soap, each in relation to a total weight of the lubricant composition. The method further includes lubricating the work tool with the lubricant composition, the work tool being used to process, package, produce, portion, pick, put together, store, obtain and/or convey foodstuffs, luxury foods, cosmetics, pharmaceuticals and/or feedstuffs. The content of metallocene-catalyzed polyalphaolefin is at least 10 wt. % in relation to the total weight of the lubricant composition, and/or the content of acid-catalyzed polyalphaolefin is at least 10 wt. % in relation to the total weight of the lubricant composition.

22 Claims, No Drawings

(56) References Cited

FOREIGN PATENT DOCUMENTS

| | | | | |
|---|---|---|---|---|
| JP | 2008143958 | | * | 6/2008 |
| JP | 5450935 | B2 | | 3/2014 |
| JP | 2014167075 | A | | 9/2014 |
| JP | 2018119038 | A | | 8/2018 |
| JP | 2021155560 | | * | 10/2021 |

* cited by examiner

USE OF A LUBRICANT COMPOSITION FOR LUBRICATING WORK TOOL

CROSS REFERENCE TO RELATED APPLICATIONS

This application is a U.S. National Phase application under 35 U.S.C. § 371 of International Application No. PCT/EP2022/081271, filed on Nov. 9, 2022, and claims benefit to European Patent Application No. EP 22164549.2, filed on Mar. 25, 2022. The International Application was published in German on Sep. 28, 2023 as WO 2023/179897 A1 under PCT Article 21 (2).

FIELD

The invention relates to a lubricant composition for lubricating a work tool which is used to process, in particular to package, produce, portion, pick, put together, store, obtain and/or convey foodstuffs, luxury foods, cosmetics, pharmaceuticals and/or feedstuffs.

BACKGROUND

Lubricants used to lubricate work tools for processing foodstuffs, luxury foods, cosmetics, pharmaceuticals and/or feedstuffs are subject to particular requirements with regard to their environmental compatibility and toxicity. For example, a lubricant should be food-safe if the lubricant can come into direct or indirect contact with cosmetics, foodstuffs and luxury foods. Important fields of application in the food industry include chains in ovens and other high-temperature applications, as well as transport hangers, in particular trolleys and their bearings. Food-safe lubricants are, however, also required in other applications such as in packaging devices, for example for cigarettes.

Food-safe lubricants are subject to legal regulations, such as NSF/H1 or NSF/H2 certification. The classification "H1" is to be achieved by lubricants that are in "incidental food contact," i.e., in occasional, technically unavoidable contact with foodstuffs. However, intentional or continuous contact is to be ruled out even when using "H1" lubricants. Lubricants that are non-toxic and non-carcinogenic can achieve an "H2" classification. However, any contact with the foodstuffs must be excluded when using "H2" lubricants.

In the well-known food-safe lubricants, aluminum complex soaps are often used as thickeners because they are "H1" compatible. Aluminum complex soaps have been known as thickeners for lubricating grease compositions for a long time and are described in many literature sources, for example in J. L. Dreher, T. H. Koundakijan and C. F. "Manufacture and Properties of Aluminum Complex Greases," NLGI Spokesman, 107-113, 1965; H. W. Kruschwitz "The Development of Formulations for Aluminum Complex Thickener Systems" NLGI Spokesman, 51-59, 1976; H. W. Kruschwitz "The Manufacture and Uses of Aluminum Complex Greases" NLGI National Meeting Preprints 1985.

A disadvantage of lubricants containing aluminum complex soaps, however, is that they do not have satisfactory technical performance for some applications in food processing. For example, the food-safe lubricants containing aluminum complex soaps used to date do not have the desired wear resistance and/or have poor resistance to seals for some applications in food processing. It would therefore be desirable to obtain a lubricant that can be formulated to be "H1" compatible and that does not have these disadvantages.

CN 107955694 A describes a lubricating grease for food machinery that is produced from, in relation to the weight, 250-350 parts base oil, 50-60 parts fatty acid, 10-20 parts calcium hydroxide, 5-10 parts hydroxide lithium, 1-3 parts inorganic acid, 3-5 parts antioxidant and 8-12 parts rust inhibitor, the inorganic acid being boric acid. The lubricating grease is intended to have a high dropping point of up to 260 °C and good corrosion resistance. The disadvantage of this lubricating grease is the high proportion (1-3 wt. %) of boric acid, as it is harmful to health.

CN 107987943 A describes a lubricant for food processing machinery that contains 30 to 40 parts by weight of palm oil, 20 to 30 parts of rice bran oil, 10 to 20 parts of sulfurized lard, 5 to 10 parts of modified soybean oil, 4 to 8 parts of catechin gallate, 3 to 6 parts of sodium laurylsulfonate, 3 to 6 parts of propylene glycol fatty acid ester, 2 to 4 parts of soybean phospholipids, 2 to 5 parts of monoalkyl ether phosphate triethanolamine salt, 0.5 to 1 part of thiobisphenol, 2 to 4 parts of lithium 12-hydroxystearate, 1 to 2 parts of zinc stearate, 1.2 to 1.5 parts of nanomolybdenum disulfide, 0.3 to 0.5 parts of zinc dialkyldithiophosphate, 1 to 3 parts of dibutylhydroxytoluene, 15 to 25 parts of water. It can be assumed that the lubricant described has an intense smell of sulfur due to the use of raw materials containing sulfur. In addition, lubricants that contain animal components, such as lard, are not well-suited to the food industry and are not usable at all for kosher foods. The use of zinc stearate is also unacceptable from a health perspective.

DE 102005013266 A1 describes the use of a lubricating grease composition consisting of at least 50 wt. % of a base oil selected from the group of hydrocarbons, polyalkylene glycols, silicone oils, esters or perfluorinated polyethers; up to 20 wt. % of at least one thickener selected from the group of soap thickeners based on aluminum, calcium, lithium, barium or sodium compounds; polyurea thickeners; polymeric thickeners or inorganic thickeners and/or up to 45 wt. % of at least one solid lubricant from the group of polymers; silicates; carbon blacks; graphites or based on metal sulfides, metal phosphates, metal oxides or metal hydroxides and up to 20 wt. % of at least one preservative selected from the group of quaternary ammonium salts; sorbic acid, formic acid or 4-hydroxybenzoic acid esters and other additives, as lubricant for beer bottling plants.

A lubricating grease composition with the following composition is described as particularly suitable:

- 63.7 wt. % mineral oil corresponding to Chemical Abstracts Substances CAS 66037-01-4;
- 12.7 wt. % aluminum stearoyl benzoyl hydroxide corresponding to CAS 68815-27-0;
- -4.5 wt. % solid lubricants in the form of metal sulfide thickeners;
- 11.5 wt. % phyllosilicate with swelling agent;
- 5.0 wt. % triglyceride esters;
- 1.05 wt. % corrosion protection additives consisting of non-ferrous metal deactivators;
- 0.5 wt. % phenolic antioxidants;
- -0.75 wt. % sulfur-and phosphorus-containing extreme pressure and antiwear additives, and
- 0.3 wt. % sorbic acid.

As explained above, lubricating grease compositions based on aluminum thickeners do not exhibit satisfactory mechanical properties for some applications. In addition, phyllosilicates, which are usually used to increase consistency, can lead to increased wear in some applications.

EP 3375850 A1 describes a food-safe high-temperature grease comprising the following components: a) 91.9 to 30 wt. % of at least one oil selected from the group consisting of a mixture of trimellitic acid tri(iso-C10) ester (1) and trimellitic acid tri(iso-C13) ester (2), wherein the mixing ratio of (1) to (2) is 99:1 to 1:99, alkyl aromatics, estolides;

b) 6 to 45 wt. % of a polymer selected from the group consisting of a hydrogenated, fully hydrogenated polyisobutylene or a mixture of hydrogenated or fully hydrogenated polyisobutylene;

c) 0.1 to 5 wt. % additives, individually or in combination, selected from the group consisting of corrosion protection additives, antioxidants, antiwear additives, UV stabilizers, inorganic or organic solid lubricants, and d) 2 to 20 wt. % thickeners. Thickeners that can be used are urea, A1 complex soaps, simple metal soaps of the elements of the first and second main groups of the periodic table, metal complex soaps of the elements of the first and second main groups of the periodic table, bentonites, sulfonates, silicates, Aerosil, polyimides, PTFE or a mixture of the aforementioned thickeners. The component can comprise a) as an additional food-safe oil a compound selected from the group consisting of mineral oil, aliphatic carboxylic acid esters and dicarboxylic acid esters, fatty acid triglycerides and polyalphaolefins. In these polar formulations containing more than 30 wt. % esters, there is a risk that it will be very difficult to adapt them to specific applications, in particular if seals based on NBR, HNBR, ACM and other polar seals are used. In particular, compensating for the potentially high swelling caused by the esters used can require a great deal of effort.

IN 201821017762 A describes greases with native oils such as castor oil, which are thickened with a Li/boron complex soap. It is stated in the description that this lubricant formulation can be used for direct food contact. The disadvantage of this composition is the content of boric acid, as this is harmful to health.

SUMMARY

In an embodiment, the present disclosure provides a method for lubricating a work tool, comprising providing a lubricant composition, the lubricant composition comprising 72 wt. % to 95 wt. % polyalphaolefin and 5 wt. % to 28 wt. % lithium soap, each in relation to a total weight of the lubricant composition. The method further comprises lubricating the work tool with the lubricant composition, the work tool being used to process, package, produce, portion, pick, put together, store, obtain and/or convey foodstuffs, luxury foods, cosmetics, pharmaceuticals and/or feedstuffs. The content of metallocene-catalyzed polyalphaolefin is at least 10 wt. % in relation to the total weight of the lubricant composition, and/or the content of acid-catalyzed polyalphaolefin is at least 10 wt. % in relation to the total weight of the lubricant composition.

DETAILED DESCRIPTION

The features and advantages of various embodiments of the present disclosure will become apparent by reading the following detailed description.

In an embodiment, the present invention provides a lubricant composition which can be used for lubricating a work tool which is used to process, in particular to package, produce, portion, pick, put together, store, obtain and/or convey foodstuffs, luxury foods, cosmetics, pharmaceuticals and/or feedstuffs, and which at least partially eliminates the aforementioned disadvantages. In particular, the lubricant composition should be able to be formulated to be "H1" compatible and yet still have good wear resistance and high resistance to elastomeric seals. In addition, the lubricant composition is intended to have improved low-temperature behavior and better temperature resistance in comparison with lubricant compositions containing aluminum complex soaps as thickeners and to show improved technical performance at least for some food processing applications.

The foregoing is achieved by the use of a lubricant composition comprising the following components:

a) 72 wt. % to 95 wt. % polyalphaolefin, b) 5 wt. % to 28 wt. % lithium soap, each in relation to the total weight of the lubricant composition, for lubricating a work tool which is used to process, in particular to package, produce, portion, pick, put together, store, obtain and/or convey foodstuffs, luxury foods, cosmetics, pharmaceuticals and/or feedstuffs, wherein the content of metallocene-catalyzed polyalphaolefin is at least 10 wt. %, more preferably from 10 wt. % to 95 wt. %, each in relation to the total weight of the lubricant composition, and/or the content of acid-catalyzed polyalphaolefin is at least 10 wt. %, more preferably from 10 wt. % to 95 wt. %, each in relation to the total weight of the lubricant composition.

In a preferred embodiment, the lubricant composition according to the present disclosure is NSF/H1 compatible. This means that it is produced using NSF/H1 compatible raw materials. NSF/H1 compatible raw materials are approved according to the rules of the National Sanitation Foundation (Code of Federal Regulations, Title 21, Volume 3, Revised as of Apr. 1, 2020, CITE: 21CFR178.3570). The approved raw materials can be published or kept confidential. As a result, the composition is very suitable for lubricating work tools in the fields mentioned above.

In practical tests it was also found that the lubricant composition has good wear resistance and high resistance to elastomeric seals. In addition, it has improved technical performance for various food processing applications in comparison with lubricant compositions containing aluminum complex soaps as thickeners. In particular, the lubricant composition exhibits the following advantages in comparison with these lubricant compositions at comparable base oil viscosity (40 °C):

flow pressure up to −50 °C a significantly lower evaporation loss even at 140 °C <50% shear viscosity difference after evaporation loss even at 140 °C a longer service life even at 120 °C improved adhesion A further advantage of using Li soap thickeners in comparison with Al complex soaps is that their thickening effect is stronger and thus firmer lubricating greases can be produced even without co-thickeners (e.g., bentonite). Al complex soap greases have a regulatory limit of a maximum of 10 wt. % pure thickener for the H1 range. With Li soaps, significantly firmer consistencies can be achieved than with Al complex greases.

In a preferred embodiment of the present disclosure, the lubricant composition comprises less than 0.1 wt. % boric acid and boric acid derivatives, each in relation to the total weight of the lubricant composition.

Boric acid derivatives are compounds which are obtained by chemical reaction of boric acid and in which a central boron atom is coordinated with three or four oxygen atoms.

Boric acid derivatives have another atom or group of atoms instead of one or more hydrogen atoms.

In the lubricant sector, boric acid derivatives are typically understood to mean compounds obtained by chemical reaction of boric acid with bases present in the lubricant composition, in particular with metal carbonates (lithium soaps) or metal hydroxides used as thickeners, i.e., metal borates and boric acid esters.

In a preferred embodiment of the present disclosure, the lubricant composition contains less than 0.1 wt. % boric acid, calcium borate and lithium borate, in relation to the total weight of the lubricant composition.

According to the present disclosure, the lubricant composition contains 72 wt. % to 95 wt. % polyalphaolefin (PAO). The PAO acts as a base oil. Preferred polyalphaolefins are NSF/H1 compatible polyalphaolefins. The advantage of polyalphaolefins is their good seal compatibility with polar seal materials, such as NBR, HNBR and ACM. They also allow improved low-temperature properties in comparison with white oils and mineral oils. Polyalphaolefins can be produced from an alpha-olefin or from mixtures of alpha-olefins, for example via acid catalysis or metallocene catalysis. According to the present disclosure, the polyalphaolefin therefore preferably comprises acid-catalyzed polyalphaolefin, metallocene-catalyzed polyalphaolefin and/or mixtures thereof. Metallocene-catalyzed PAOs (mPAO) lead to more ordered structures because rearrangement during the polymer reaction can be reduced. Preferred commercial products for mPAOs are Spectrasyn Elite 65®, Spectrasyn Elite 150®, Spectrasyn Elite 300®, Durasyn 180I®, Durasyn 174 I®, Synfluid mPAO 100 cst.®. Acid-catalyzed PAOs generally provide higher polydispersity, and isomerization is more likely to occur. Preferred commercial products are Synfluid PAO 4®, Spectrasyn 4®, Durasyn 164®, Spectrasyn 40®, Synton PAO 40®. In a preferred embodiment, the polyalphaolefin comprises mixtures of oligomers and/or polymers, as is common in commercial products. Preferred are NSF/H1 compatible polyalphaolefins selected from the aforementioned polyalphaolefins.

Also preferably, the polyalphaolefin comprises mixtures of acid-catalyzed and metallocene-catalyzed polyalphaolefins. In a further preferred embodiment, the polyalphaolefin is a polyalphaolefin produced from α-olefins selected from 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-docosene, 1-tetradocosene, and mixtures thereof. Preferred polyalphaolefins are produced from 1-octene, 1-nonene, 1-decene, 1-dodecene, 1-tridecene, 1-tetradecene and mixtures thereof or from 1-decene as the sole monomer. Preferred are NSF/H1 compatible polyalphaolefins selected from the aforementioned polyalphaolefins.

According to the present disclosure, the content of polyalphaolefin is at least 72 wt. %, preferably at least 73 wt. %, more preferably from 75 wt. % to 95 wt. %, more preferably from 78 wt. % to 92 wt. % and in particular from 80 wt. % to 90 wt. %, each in relation to the total weight of the lubricant composition.

In an embodiment of the present disclosure, the content of metallocene-catalyzed polyalphaolefin is preferably at least 10 wt. %, more preferably 10 wt. % to 95 wt. %, and/or at least 15 wt. %, more preferably from 15 wt. % to 95 wt. %, more preferably from 15 wt. % to 90 wt. % and in particular from 18 wt. % to 90 wt. %, more preferably from 10 wt. % to 60 wt. %, more preferably from 10 wt. % to 50 wt. %, more preferably from 15 wt. % to 60 wt. %, more preferably from 15 wt. % to 50 wt. %, each in relation to the total weight of the lubricant composition.

In this respect, a preferred embodiment of the present disclosure comprises the use of a lubricant composition comprising the following components:

a) 72 wt. % to 95 wt. % polyalphaolefin, b) 5 wt. % to 28 wt. % lithium soap, each in relation to the total weight of the lubricant composition, for lubricating a work tool which is used to process, in particular to package, produce, portion, pick, put together, store, obtain and/or convey foodstuffs, luxury foods, cosmetics, pharmaceuticals and/or feedstuffs, wherein the content of metallocene-catalyzed polyalphaolefin is at least 10 wt. %, more preferably from 10 wt. % to 95 and/or at least 15 wt. %, more preferably from 15 wt. % to 95 wt. %, more preferably from 15 wt. % to 90 wt. % and in particular from 18 wt. % to 90 wt. %, more preferably from 10 wt. % to 60 wt. %, more preferably from 10 wt. % to 50 wt. %, more preferably from 15 wt. % to 60 wt. %, more preferably from 15 wt. % to 50 wt. %, each in relation to the total weight of the lubricant composition.

This embodiment is advantageous because it has particularly good low-temperature properties due to the content of metallocene-catalyzed polyalphaolefin.

In a further preferred embodiment of the present disclosure, the content of acid-catalyzed polyalphaolefin is at least 10 wt. %, more preferably 10 wt. % to 95 wt. %, and/or at least 15 wt. %, more preferably from 15 wt. % to 95 wt. %, more preferably from 15 wt. % to 90 wt. % and in particular from 18 wt. % to 90 wt. %, each in relation to the total weight of the lubricant composition.

The polyalphaolefin preferably has a viscosity, measured according to ASTM D7042–21 (01.01.2021) at 100 °C, of 4 $mm^2/s$ to 350 $mm^2/s$, more preferably from 4 $mm^2/s$ to 250 $mm^2/s$ and in particular from 4 $mm^2/s$ to 180 $mm^2/s$. Preferably, the polyalphaolefin has a pour point measured according to ASTM D5950 2014-07 of at most −20 °C, preferably at most −30 °C and in particular at most −40 °C.

In addition to the polyalphaolefin, the lubricant composition can contain further base oils. Preferred further base oils are NSF/H1 compatible base oils. The term "base oil" is to be understood as meaning the customary base liquids used for the production of lubricants, in particular oils which can be assigned to the groups I, II, II+, III, IV or V in accordance with the classification of the American Petroleum Institute (API), [NLGI Spokesman, N. Samman, volume 70, number 11, pages 14 et seqq.]. Preferred further base oils are selected from the group consisting of esters, ethers, in particular polyethers, phenyl ethers, perfluoropolyethers, mineral oils, white oils, synthetic hydrocarbons which do not belong to the class of polyalphaolefins, in particular alkylated naphthalenes, copolymers of unsaturated hydrocarbons, for example polymers of ethylene and alphaolefins (for example Lucant HC-600®), natural hydrocarbons, native oils and derivatives of native oils, silicone oils, and mixtures thereof, wherein these further base oils are preferably NSF/H1 compatible.

Further base oils which are preferred according to the present disclosure are esters, ethers, preferably polyethers, diphenyl ethers, polyphenyl ethers, synthetic hydrocarbons, alkylated naphthalenes, white oils, copolymers of unsaturated hydrocarbons and/or mixtures thereof, wherein these further base oils are preferably NSF/H1 compatible. Preferred are ethers, preferably polyalkylene glycols, in particular polypropylene glycol homopolymers and/or copolymers with ethyl groups and 1-methylethyl groups as carbon groups in the repeating unit, wherein these further base oils are preferably NSF/H1 compatible.

In a preferred embodiment of the present disclosure, the further base oil is selected from the group consisting of esters, ethers, preferably polyethers, synthetic hydrocarbons, white oils, perfluoropolyethers, alkylated naphthalenes and mixtures thereof, wherein these base oils are preferably NSF/H1 compatible.

Preferred further base oils are polyethers. Polyethers are understood to mean polymers with organic repeating units formed from ether functionalities (C—O—C). In the subgroup of polyphenyl ethers, the carbon portion of the repeating unit consists of phenyl groups. In the subgroup of polyalkylene glycols, the carbon portion of the repeating unit consists of substituted or unsubstituted ethyl groups (O—C—C—O), such as ethyl groups, 1-methylethyl groups, 1-ethylethyl groups. Such polyalkylene glycol homopolymers are typically also referred to as polyethylene glycol, polypropylene glycol and polybutylene glycol. Polyalkylene glycols are also referred to as polymers which contain mixtures of differently substituted ethyl groups such as ethyl groups, 1-methylethyl groups, 1-ethylethyl groups as carbon portions of the repeating unit. These polyalkylene glycols can exist both as block polymers and as polymers with a statistical distribution of the carbon groups. Other preferred polyethers are polytetrahydrofurans and oxetane polymers, which have four carbons (O—C—C—C—C—O) and three carbons (O—C—C—C—O), respectively, in the carbon portion of the repeating unit.

Preferred polyethers are polyalkylene glycols. Preferred polyalkylene glycols are polypropylene glycol homopolymers and/or copolymers with ethyl groups and 1-methylethyl groups as carbon groups in the repeating unit.

The end groups of the polyalkylene glycols, polytetrahydrofurans and oxetane polymers are, independently of one another, preferably hydroxide groups and/or alkoxide groups, wherein the alkyl portion of the alkoxide groups can be formed from C1 to C20 alkyl groups. The end groups of the polyalkylene groups can be additionally substituted. The end group can be introduced during the production of the polyalkylene glycols, polytetrahydrofurans and oxetane polymers by reacting the monomeric ethylene oxides, tetrahydrofurans or oxetanes with a monofunctional starter. Monofunctional starters are preferably alcohols, in particular butanol. Two or more chains of polyalkylene glycols, polytetrahydrofurans and oxetane polymers can also be linked via an end group. Alkyl groups are preferred as linking end groups. This can be done in the production of the polyalkylene glycols, polytetrahydrofurans and oxetane polymers from ethylene oxides, tetrahydrofurans or oxetanes with a nucleophilic di-or higher functional starter. Examples of difunctional starters are diols, in particular 1,2-ethanediol.

Preferred polyethers are polyalkylene glycols, more preferably polypropylene glycol homopolymers and/or copolymers with ethyl groups and 1-methylethyl groups as carbon groups in the repeating unit. The aforementioned polyalkylene glycols are also preferred when butanol or 1,2-ethanediol are used as starters. The aforementioned polyalkylene glycols are also preferred if they have a butyl group as an end group and/or are linked via an ethylene group.

Preferred esters are carboxylic acid esters, preferably monoesters, diesters, triesters, tetraesters, pentaesters, polyesters, estolides and mixtures thereof. Preferred are diesters, triesters, tetraesters, pentaesters, polyesters, estolides and mixtures thereof. Estolides are preferred because they can be particularly suitable for food lubricants.

Preferred esters are also aromatic esters, preferably of aromatic di-, tri- or tetracarboxylic acids with one or a mixture of C7 to C22 alcohols and aliphatic esters, preferably of monocarboxylic acids and/or dicarboxylic acids with a mono-, di-, tri-, tetra, penta, hexa-alcohol having a carbon number of 3 to 22 present individually or in mixtures, polyol esters, such as preferably complex esters, estolides and mixtures thereof, wherein these esters are preferably NSF/H1 compatible. The acid component and/or alcohol component of the carboxylic acid esters preferably has, independently of one another, a number of carbon atoms from C3 to C54.

Estolides are oligomers of aliphatic hydroxycarboxylic acids, preferably of 12-hydroxystearic acid or oligomers of unsaturated carboxylic acids, preferably of oleic acid, in which the terminal carboxylic acid group is esterified with a monoalcohol, dialcohol, trialcohol and/or tetraalcohol, preferably branched monoalcohols, preferably Guerbet alcohols, and in which any free hydroxide groups can be esterified by reaction with monocarboxylic acids or dicarboxylic acids.

Preferred are aliphatic esters of monocarboxylic acids and/or dicarboxylic acids having a carbon number of C3 to C40 with a mono-, di-, tri-, tetra, penta, hexa-alcohol having a carbon number of 3 to 22, present individually or in mixtures.

Preferred are aliphatic esters of monocarboxylic acids and/or dicarboxylic acids having a carbon number of C3 to C40 with a mono-, tri-, tetra, hexa-alcohol having a carbon number of 3 to 22, present individually or in mixtures.

Preferred are aliphatic esters of monocarboxylic acids having a carbon number of C5 to C22 with a tri, tetra, hexa-alcohol having a carbon number of C3 to C10, in particular trimethylolpropane, pentaerythritol and/or dipentaerythritol, present individually or in mixtures, and/or of dicarboxylic acids, having a carbon number of C6 to C40, in particular C18 dimer acids, with a mono- and/or dialcohol having a carbon number of 6 to 22, present individually or in mixtures.

Preferred are esters of trimethylolpropane, pentaerythritol and/or dipentaerythritol with aliphatic C7 to C22 carboxylic acids and/or esters of C18 dimer acids with C7 to C22 alcohols. NSF/H1 compatible esters are preferred.

Preferably, the proportion of the further base oil in the lubricant composition, if present, is from 4 to 23 wt. %, more preferably from 5 to 22 wt. %, in particular from 6 to 20 wt. %, each in relation to the total weight of the lubricant composition.

In addition, the lubricant composition according to the present disclosure contains 5 wt. % to 28 wt. % lithium soap as thickener. Lithium soaps are lithium salts, usually lithium salt mixtures, of preferably organic acids and/or the esters thereof, which have been reacted with lithium hydroxide to form salts. Accordingly, lithium soaps can be produced by reacting organic acids and/or the esters thereof with lithium hydroxide. Preferred lithium soaps are prepared from mixtures of different carboxylic acids and/or the esters thereof, since the technically available products usually contain such mixtures.

Preferred lithium soaps are NSF/H1 compatible lithium soaps. Preferably, the proportion of lithium soap in the lubricant composition according to the present disclosure is from 5 wt. % to 26 wt. %, more preferably from 5 wt. % to 22 wt. % and in particular from 5 wt. % to 18 wt. %, each in relation to the total weight of the lubricant composition.

Lithium soaps preferred according to the present disclosure are simple lithium soaps, lithium complex soaps and/or mixtures thereof. Simple lithium soaps are lithium salts, usually lithium salt mixtures, of monofunctional, preferably organic, acids and/or the esters thereof, which have been reacted with lithium hydroxide to form salts. Typically, the dropping point of lubricant compositions containing simple lithium soaps is at most 210 °C, for example in the range of 180 °C to 210 °C, more preferably at most 200 °C, for example in the range of 180° C. to 200 °C (ASTM D2265 May 20, 2020). Lithium complex soaps are complex lithium salt mixtures, i.e., mixtures of various, preferably organic, acids and/or the esters thereof, which have been reacted with lithium hydroxide to form salts, the mixture containing a proportion of di-or higher functional acids and/or esters. The acids and/or esters can have, independently of one another, further functionalities, for example alcoholic hydroxide groups and/or acid amide groups. Lubricant compositions containing lithium complex soaps can have high dropping points, typically above 210 °C, for example from 210 °C to 300 °C, more preferably above 230° C., for example from 230 °C to 300 °C (ASTM D2265 May 20, 2020). Furthermore, such lubricant compositions have good water resistance and wide operating temperature ranges. Therefore, in a preferred embodiment, the lubricant composition contains lithium complex soap.

In a preferred embodiment, the lubricant composition contains a lithium complex soap, produced from C4-C36 dicarboxylic acids, preferably azelaic acid, sebacic acid, suberic acid, terephthalic acid, dodecanedioic acid and/or from higher-functional carboxylic acids with 3 or more, preferably 3 to 4, carboxylic acid groups, wherein the number of carbon groups can be 6 to 60, such as preferably citric acid and/or trimer acids, and/or from ester compounds, in particular methyl esters and/or triglycerides of one or more of the aforementioned acids, each combined with one or more monocarboxylic acids, preferably combined with one or more C4-C24 monocarboxylic acids, preferably stearic acid, hydroxystearic acid, in particular 12-hydroxystearic acid, palmitic acid, oleic acid, salicylic acid, ester compounds, in particular methyl esters and/or triglycerides of one or more of the aforementioned acids and/or combined with sebacic acid monostearylamide and/or terephthalic acid monostearylamide. Preferred are NSF/H1 compatible lithium complex soaps, selected from the lithium complex soaps mentioned above. Trimer acids are understood to mean tricarboxylic acids obtained by trimerization of unsaturated fatty acids with preferably 54 carbon atoms, which contain alkyl side chains, double bonds and cyclic ring systems.

Preferred lithium complex soaps are produced from ester compounds, in particular methyl esters and/or triglycerides of the aforementioned carboxylic acids. Preferred are NSF/H1 compatible lithium complex soaps, selected from the lithium soaps mentioned above.

In a further preferred embodiment, the lubricant composition contains simple lithium soap, preferably simple lithium soap which is produced from C4-C24 monocarboxylic acid, preferably stearic acid, hydroxystearic acid, in particular 12-hydroxystearic acid, palmitic acid, oleic acid, salicylic acid, ester compounds, in particular methyl esters and/or triglycerides of one or more of the aforementioned acids, sebacic acid monostearylamide, terephthalic acid monostearylamide and mixtures thereof.

Preferred are NSF/H1 compatible simple lithium soaps, selected from the lithium soaps mentioned above. Preferred simple lithium soaps are produced from mixtures of hydroxystearic acid, in particular 12-hydroxystearic acid and/or the esters thereof on the one hand and stearic acid and/or the esters thereof on the other hand. The proportion of hydroxystearic acid, in particular 12-hydroxystearic acid and the esters thereof, in relation to the total weight of: hydroxystearic acid, the esters thereof, stearic acid and the esters thereof, in the mixture is preferably 80 wt. % to 90 wt. %. The proportion of stearic acid and the esters thereof in relation to the total weight of: hydroxystearic acid, the esters thereof, stearic acid and the esters thereof, in the mixture is preferably 10 wt. % to 20 wt. %.

Preferred simple lithium soaps are produced from ester compounds, in particular methyl esters and/or triglycerides of the aforementioned carboxylic acids. Preferred are NSF/H1 compatible simple lithium soaps, selected from the lithium soaps mentioned above.

In addition to the lithium soap, the lubricant composition can contain further thickeners as co-thickeners, for example phyllosilicates, in particular talc and/or mica, amorphous, hydrophilic and/or hydrophobized silicon dioxide, in particular Aerosil, urea thickeners, metal soap thickeners, in particular aluminum (Al), calcium (Ca), barium (Ba), sodium (Na), magnesium (Mg) polymer thickeners and/or waxes. Preferred further thickeners as co-thickeners comprise phyllosilicates, in particular talc and/or mica, amorphous, hydrophilic and/or hydrophobized silicon dioxide, in particular Aerosil, urea thickeners, metal soap thickeners, in particular aluminum (Al), calcium (Ca), sodium (Na), magnesium (Mg) polymer thickeners and/or waxes. Preferred are NSF/H1 compatible co-thickeners, selected from the co-thickeners mentioned above. If present, the amount of co-thickener in the lubricant composition according to the present disclosure is preferably 0.5 wt. % to 23 wt. %, more preferably 0.5 wt. % to 20 wt. % and in particular 0.5 wt. % to 12 wt. %, each in relation to the total weight of the lubricant composition. Preferred further thickeners are NSF/H1 compatible thickeners. In a preferred embodiment of the present disclosure, however, the proportion of co-thickener, in particular phyllosilicate, is less than 5 wt. %. This is advantageous because wear can be kept low and settling behavior can be optimized thereby.

In a preferred embodiment of the present disclosure, the lubricant composition comprises from 0.5 wt. % to 23 wt. %, more preferably from 0.5 wt. % to 20 wt. %, in particular from 0.5 wt. % to 10 wt. % polyisobutylene, each in relation to the total weight of the lubricant composition. The polyisobutylene can be hydrogenated, partially hydrogenated or unhydrogenated. Preferred polyisobutylene is an NSF/H1 compatible polyisobutylene. Fully hydrogenated polyisobutylene is also preferred because it has improved temperature resistance. The advantage of using polyisobutylene in the lubricant composition according to the present disclosure is that it can act as a viscosity index improver. Another advantage is that it allows an increase in base oil viscosity and an improvement in adhesion. According to a further preferred embodiment, the polyisobutylene has a number-average molecular weight of 115 to 10,000 g/mol, preferably 160 to 5000 g/mol. The molecular weight is determined using DIN 55672-1:2016-03 Gel permeation chromatography (GPC)—Part 1: Tetrahydrofuran (THF) as eluent. At molecular weights below 115 g/mol, the polyisobutylene tends to evaporate a lot and does not improve adhesion sufficiently. For molecular weights greater than 10,000 g/mol, the shear resistance is not sufficient.

In a preferred embodiment, the lubricant composition contains a solid lubricant. Preferred solid lubricants are NSF/H1 compatible solid lubricants. Inorganic or organic solid lubricants can be provided. Preferred solid lubricants are selected from the group consisting of: polytetrafluoroethylene (PTFE), nitrides, preferably boron nitride, in particular hexagonal boron nitride, metal carbonates, in particular calcium carbonate, potassium carbonate, sodium bicarbonate, potassium dicarbonate, sodium carbonate, zinc carbonate, metal sulfides, in particular zinc(II) sulfide, metal phosphates, in particular calcium hexamethaphosphate, di- and tribasic magnesium phosphate, mono-, di- and tribasic calcium phosphate, mono-, di- and tribasic potassium phosphate, potassium polymetaphosphate, potassium pyrophosphate, potassium tripolyphosphate, acidic sodium pyrophosphate, sodium hexametaphosphate, sodium metaphosphate, mono-, di- and tribasic sodium phosphate, sodium trimetaphosphate, sodium tripolyphosphate, zirconium phosphate, calcium phosphate, calcium pyrophosphate, zinc pyrophosphate, metal oxides, in particular titanium dioxide, magnesium oxide, zinc oxide, aluminum oxide, tungsten oxide, metal carboxylates, disodium sebacate, silicates excluding phyllosilicates, in particular potassium silicates, calcium silicates, magnesium silicates, sodium silicates, talc (basic magnesium silicate), tricalcium silicate, aluminosilicate, aluminum calcium silicate, sodium aluminum silicate, acidic and basic sodium aluminum silicate, sodium calcium aluminum silicate, metal hydroxide, in particular calcium hydroxide, magnesium hydroxide, potassium hydroxide and mixtures of the solid lubricants. Preferred solid lubricants are disodium sebacate, polytetrafluoroethylene (PTFE), hexagonal boron nitride, calcium carbonate and/or calcium pyrophosphate.

Preferred are NSF/H1 compatible solid lubricants, selected from the solid lubricants mentioned above. Preferably, the proportion of solid lubricant in the lubricant composition according to the present disclosure is from 0.5 wt. % to 23 wt. %, more preferably from 0.5 wt. % to 20 wt. % and in particular from 0.5 wt. % to 18 wt. %, each in relation to the total weight of the lubricant composition.

In a further preferred embodiment, the proportion of solid lubricant, preferably disodium sebacate, polytetrafluoroethylene (PTFE), hexagonal boron nitride, calcium carbonate and/or calcium pyrophosphate in the lubricant composition according to the present disclosure is 5 wt. % to 23 wt. %, more preferably 10 wt. % to 23 wt. % and in particular 15 wt. % to 23 wt. %, each in relation to the total weight of the lubricant composition. These higher amounts have the advantage that the solid lubricant can simultaneously have a thickening effect.

The lubricant composition can also contain conventional additives such as corrosion protection additives, metal deactivators, viscosity index improvers, antiwear additives and/or ion complexing agents. Preferred are NSF/H1 compatible additives selected from the additive groups mentioned above. Preferably, the proportion of additives in the lubricant composition according to the present disclosure is from 0.5 wt. % to 23 wt. %, more preferably from 0.5 wt. % to 15 wt. % and in particular from 0.5 wt. % to 10 wt. %, each in relation to the total weight of the lubricant composition.

In a preferred embodiment of the present disclosure, the lubricant composition comprises the following components:

a) 36 wt. % to 55 wt. % acid-catalyzed polyalphaolefin,
b) 36 wt. % to 55 wt. % metallocene-catalyzed polyalphaolefin,
c) 1 wt. % to 15 wt. % polyisobutylene,
d) 5 wt. % to 15 wt. % lithium soap,
e) 1 wt. % to 10 wt. % solid lubricant,
f) 0.5 wt. % to 7 wt. % additives,
each in relation to the total weight of the lubricant composition.

Preferably, components a) to f) are NSF/H1 compatible compounds.

In a preferred embodiment of the present disclosure, the aforementioned lubricant composition comprises less than 0.1 wt. % boric acid and boric acid derivatives, each in relation to the total weight of the lubricant composition. In a preferred embodiment of the present disclosure, the lubricant composition comprises the following components:

a) 36 wt. % to 45 wt. % acid-catalyzed polyalphaolefin,
b) 36 wt. % to 45 wt. % metallocene-catalyzed polyalphaolefin,
c) 4 wt. % to 8 wt. % polyisobutylene,
d) 5 wt. % to 10 wt. % lithium soap,
e) 1 wt. % to 4 wt. % solid lubricant,
f) 1 wt. % to 3 wt. % % additives,
each in relation to the total weight of the lubricant composition.

Preferably, components a) to f) are NSF/H1 compatible compounds.

In a preferred embodiment of the present disclosure, the aforementioned lubricant composition comprises less than 0.1 wt. % boric acid and boric acid derivatives, each in relation to the total weight of the lubricant composition. In a preferred embodiment of the present disclosure, the lubricant composition consists of the following components:

a) 36 wt. % to 45 wt. % acid-catalyzed polyalphaolefin,
b) 36 wt. % to 45 wt. % metallocene-catalyzed polyalphaolefin,
c) 4 wt. % to 8 wt. % polyisobutylene,
d) 5 wt. % to 10 wt. % lithium soap,
e) 1 wt. % to 4 wt. % solid lubricant,
f) 1 wt. % to 3 wt. % % additives,
each in relation to the total weight of the lubricant composition.

Preferably, components a) to f) are NSF/H1 compatible compounds.

In a preferred embodiment of the present disclosure, the aforementioned lubricant composition comprises less than 0.1 wt. % boric acid and boric acid derivatives, each in relation to the total weight of the lubricant composition.

According to the present disclosure, lubrication of a work tool is understood to mean in particular the lubrication of tribologically stressed components of the work tool, such as the lubrication of rolling bearings, linear guides, hydraulic and pneumatic components, seals, plain bearings, chains, valves and/or fittings of the work tool. The lubricant can be used both for the operation of the work tool and for the maintenance of the work tool.

According to the present disclosure, the work tool is used to process, in particular to package, produce, portion, store, pick, put together, obtain and/or convey foodstuffs, luxury foods, cosmetics, pharmaceuticals and/or feedstuffs. According to the present disclosure, preferred work tools include packaging machines, production machines, dismantling machines, assembly machines, order picking machines and/or conveying machines.

In a preferred embodiment, the use according to the present disclosure comprises the lubrication of packaging machines for foodstuffs and cosmetics, in particular packaging machines for cigarettes and/or the lubrication of transport chains and/or control chains.

EXAMPLES

Embodiments of the invention are explained in more detail below with reference to several examples.

| | Lithium soap production | Aluminum soap production |
|---|---|---|
| Stage 1 | Approximately 30% oil feed into the production boiler. Depending on the intended consistency, it may also be useful to add a larger amount of oil. | Approximately 50% oil feed into the production boiler. Depending on the intended consistency, it may also be necessary to add a larger amount of oil. |
| Stage 2 | Addition of the carboxylic acid (e.g., 12-hydroxystearic acid) | Heating to approximately 80 °C |
| Stage 3 | Heating to approximately 80 to 100 °C (depending on acid and base oil: clear solution) | Addition of stearic acid and benzoic acid (clear solution) |
| Stage 4 | Careful addition of a lithium hydroxide solution at approximately 50-80 °C (approximately 30 min) | Approximately 60 min stirring time |
| Stage 5 | To drive out the water, heating is carried out to 130 °C | Addition of the aluminum component (polyoxoaluminum stearate, usually in flux oil) |
| Stage 6 | Optionally, a further base oil can now be added. | Approximately 60 min stirring time |
| Stage 7 | Heating to approximately 210 °C. The aim is generally to acheive a clear melt. | Heating to approximately 200-210 °C |

-continued

| | Lithium soap production | Aluminum soap production |
|---|---|---|
| | This depends substantially on the acid and base oil used. For example, if 12-hydroxystearic acid in PAO is used, the melting range is ideally between 200 and 210 °C. | |
| Stage 8 | Boiler heating is switched off. | Cooling by boiler heating to approximately 190 °C |
| Stage 9 | First cooling step by adding the base oil that has not yet been used. | Addition of the remaining base oil |
| Stage 10 | Further cooling by boiler cooling to approximately 60 °C. | Further cooling to approximately 60 °C |
| Stage 11 | Addition of additives. Additives with a melting point between 60 and 180 °C can be added during the cooling phase, ideally at a temperature 20 °C above the melting point of the additive. | Addition of additives. Additives with a melting point between 60 and 180 °C can be added during the cooling phase, ideally at a temperature 20 °C above the melting point of the additive. |
| Stage 12 | After the additives have been added, stirring is carried out for approximately 60 more minutes. | After the additives have been added, stirring is carried out for approximately 60 more minutes. |
| Stage 13 | The grease is then homogenized, for example using a three-roll mill. | For grease is then homogenized, for example using a three-roll mill. |

When carboxylic acid esters are used instead of the free carboxylic acid as raw material for the thickener, there is no fundamental change in production. If a lithium soap is used instead of the free carboxylic acid as raw material for the thickener, after approximately 30% base oil is mixed with the lithium soap, heating is carried out directly to 210 °C while stirring.

In the lubricant compositions according to the present disclosure, the proportion of metallocene-catalyzed PAO is always at least 10 wt. %.

Example 1: Comparison of the Lithium Soap Grease 1 According to the Present Disclosure With the Al Complex Soap Grease 2 (Comparative Grease)

A lithium soap grease 1 according to the present disclosure and an Al complex soap grease 2 (comparative grease) with the composition given below in Table 1 are produced. Both the lithium soap grease 1 according to the present disclosure and the Al complex soap grease 2 are H1 compatible due to their composition.

Both greases are subjected to the technical tests given in Table 1. For the elastomer tests, the samples are prepared as follows: For the static immersion test in the grease, at least 5 standard S2 shouldered test bars (DIN 53504) are used to determine the tensile strength and elongation at break, and at least 3 round blanks (Ø 36.6 mm) are punched out of an elastomer plate with a thickness of 2 (±0.2) mm to determine the volume and hardness.

For immersion, the volume of the grease is at least 15 times the total volume of the test specimens in accordance with DIN ISO 1817.

The results of the tests are indicated in Table 1 below.

TABLE 1

Comparison of lithium soap grease 1 with Al complex soap grease 2 (comparative grease)

| Properties | Test units | Comparative grease 2 | Grease 1 according to the present disclosure |
|---|---|---|---|
| Base oil composition | | 66 wt. % PAO<br>4 wt. % Flux oil<br>5 wt. % ester | 82 wt. % PAO<br>6 wt. % Polyisobutylene |
| Thickener | | 6 wt. % Al complex soap<br>10 wt. % Bentonite-based co-thickener | 8 wt. % Li soap |
| Addition of additives | | 5 wt. % Antiwear protection<br>1 wt. % Anti-aging protection<br>3 wt. % Corrosion protection | 2 wt. % Anti-wear protection<br>1 wt. % Anti-aging protection<br>1 wt. % Corrosion protection |
| Base oil viscosity at 40 °C DIN 51562 T01 | [$mm^2/s$] | 260 | 300 |
| Consistency DIN ISO 2137 | [0.1 mm] | 288 | 313 |
| FBT (25 °C, 60 min, 400N) DIN 51350 | [mm] | 0.59 | 0.44 |
| SRV (reciprocating friction and wear) (200N, 50 Hz, 2 mm, 2 h, 25 °C, ball on disc) steel test specimen 100Cr6 | | $\mu_{start}$: 0.112-0.143<br>$\mu_{run}$: 0.115-0.566<br>Terminated after 8 min because $\mu > 0.5$ | $\mu_{start}$: 0.123-0.132<br>$\mu_{run}$: 0.115-0.128 |
| Change in Shore hardness A ISO 1817, 1008 h, 100 °C, | | −6 | 2 |
| Volume change ISO 1817, 1008 h, 100 °C, NBR | [%] | 4 | −1 |

TABLE 1-continued

| Comparison of lithium soap grease 1 with Al complex soap grease 2 (comparative grease) | | | |
|---|---|---|---|
| Properties | Test units | Comparative grease 2 | Grease 1 according to the present disclosure |
| Elongation at break ISO 1817, 1008 h, 100 °C, NBR | [%] | 31 | −1 |
| Tensile strength ISO 1817, 1008 h, 100 °C, NBR | [%] | −10 | 2 |
| Change in Shore hardness A ISO 1817, 1008 h, 130 °C, FKM | | 4 | 1 |
| Volume change ISO 1817, 1008 h, 130 °C, FKM | [%] | 44 | 0 |
| Elongation at break ISO 1817, 1008 h, 130 °C, FKM | [%] | −68 | −23 |
| Tensile strength ISO 1817, 1008 h, 130 °C, FKM | [%] | −51 | −7 |
| Flow pressure at-40 °C DIN 51805-2 | [mbar] | >2700 | 350 |
| Flow pressure at-50 °C DIN 51805-2 | [mbar] | NA | 700 |
| Evaporation loss according to DIN 58397 at 140 °C, 168 h | % | 9 | 2 |

Table 1 shows that the composition 1 according to the present disclosure exhibits improved properties with regard to low temperature suitability (see flow pressure results) and with regard to its compatibility with NBR and FKM elastomer as well as a higher wear resistance and a higher load-bearing capacity (see SRV and FBT results). In addition, the temperature resistance of the lithium soap grease 1 according to the present disclosure at 140 °C is also significantly improved, which is evident from the lower evaporation.

Example 2: Comparison of the Lithium Soap Grease 4 According to the Present Disclosure with the Al Complex Soap Grease 3 (Comparative Grease)

A lithium soap grease 4 according to the present disclosure and an Al complex soap grease 3 (comparative grease) with the composition given below in Table 2 are produced. Both the lithium soap grease 4 according to the present disclosure and the Al complex soap grease 3 are H1 compatible due to their composition. Both greases are subjected to the technical tests given in Table 2.

TABLE 2

| Comparison of lithium soap grease 4 with the Al complex soap grease 3 (comparative grease) | | | |
|---|---|---|---|
| Properties | Test units | Grease 4 according to the present disclosure | Comparative grease 3 |
| Base oil | | 85 wt. % PAO | 70 wt. % PAO<br>6 wt. % Ester<br>6 wt. % Polyiso-butylene |
| Thickener | | 10 wt. % Li soap | 9 wt. % Al soap<br>2 wt. % Bentonite |
| Additives | | 3 wt. % Antiwear protection<br>1 wt. % Anti-aging protection<br>1 wt. % Corrosion protection | 3 wt. % Antiwear protection<br>1 wt. % Anti-aging protection<br>3 wt.% Corrosion protection |
| Base oil viscosity at 40 °C DIN 51562 T01 | [$mm^2/s$] | 108 | 150 |
| Consistency DIN ISO 2137 | [0.1 mm] | 338 | 325 |

TABLE 2-continued

| Comparison of lithium soap grease 4 with the Al complex soap grease 3 (comparative grease) | | | |
|---|---|---|---|
| Properties | Test units | Grease 4 according to the present disclosure | Comparative grease 3 |
| FAG FE 9 based on DIN 51821 (1500N, 6000 1/min, 120 °C, 2 $cm^3$ grease) Installation A | [h] | L50 = 506 | L50 = 58 |

It is shown that the temperature resistance of the lithium soap grease 4 according to the present disclosure is significantly improved at 120 °C, which is reflected in a longer service life in the FE 9 testing machine.

Example 3: Comparison of the Lithium Soap Greases 6 and 7 According to the Present Disclosure The lithium soap greases 6 and 7 according to the present disclosure with the composition given below in Table 3 are produced. All the greases are H1 compatible due to their composition. The greases are subjected to the technical tests given in Table 3.

TABLE 3

| Comparison of the lithium soap greases 6 according to the present disclosure and 7 according to the present disclosure | | | |
|---|---|---|---|
| Properties | Test units | Grease 6 to the present disclosure | Grease 7 according to the present disclosure |
| Base oil | | 83 wt. % PAO 6 wt.% Polyisobutylene | 89 wt. % PAO |
| Thickener | | 11 wt. % Li soap | 11 wt. % Li soap |
| Additives | | none | none |
| Base oil viscosity at 40 °C DIN 51562 T01 | [$mm^2$/s] | 300 | 300 |
| Consistency DIN ISO 2137 | [0.1 mm] | 278 | 291 |
| Flow pressure at −40 °C DIN 51805-2 | [mbar] | 350 | 325 |
| Normal force in tackiness test, Anton Paar MCR302 rheometer, measuring system measuring geometry: PP25/TG-SN27330; [d = 1.25 mm], speed 5 mm/s temperature: 25 °C | N | 3.3 | 2.9 |

In the tackiness test, the grease 6 containing polyisobutylene exhibits a higher force to break the lubricating film when the measuring system is moved apart.

Example 4: Comparison of the Lithium Soap Grease 9 According to the Present Disclosure With the Al Complex Soap Grease 8 (Comparative Grease) With Regard to the Thickening Effect of the Thickeners The lithium soap grease 9 according to the present disclosure and the Al complex soap grease 8 (comparative grease) with the composition given below in Table 4 are produced. Both greases are H1 compatible due to their composition. The greases are compared with one another with regard to their consistency. The results are indicated in Table 4.

TABLE 4

| Comparison of the lithium soap grease 9 with the Al complex soap grease 8 (comparative grease) with regard to the thickening effect of the thickeners | | | |
|---|---|---|---|
| Properties | Test units | Comparative grease 8 | Grease 9 according to the present disclosure |
| Base oil | | 84 wt. % PAO 6 wt. % Flux oil | 90 wt. % PAO |
| Thickener | | 10 wt. % Al complex | 10 wt. % Li soap |
| Additives | | none | none |
| Base oil viscosity at 40 °C DIN 51562 T01 | [$mm^2$/s] | 100 | 100 |
| Consistency DIN ISO 2137 | [0.1 mm] | 311 | 265 |

It is shown that the grease 9 according to the present disclosure with a Li thickener content of 10 wt. % achieves a consistency of 265, while the corresponding Al complex grease 8 with a thickener content of 10 wt. % only achieves a consistency of 311. Increasing the amount of thickener is no longer possible, as food approval is then no longer possible. Firmer consistencies <310 are therefore difficult to achieve for Al complex soaps without co-thickeners such as bentonite. It was therefore shown that the thickening effect of the aluminum thickener is lower than that of the lithium thickener.

Example 5: Comparison of the Lithium Soap Grease 11 According to the Present Disclosure With the Al Complex Soap Grease 10 (Comparative Grease) With Regard to low-Temperature Behavior and High-Temperature Behavior

TABLE 5

Comparison of the Al complex soap grease 10 (comparative grease) with thelithium soap grease 11 according to the present disclosure

| Properties | Test units | Comparative grease 10 | Grease 11 according to the present disclosure |
|---|---|---|---|
| Base oil | | 84 wt. % PAO<br>6 wt. % Flux oil | 90 wt. % PAO |
| Thickener | | 10 wt. % Al complex | 10 wt. % Li soap |
| Additives | | none | none |
| Base oil viscosity at 40 °C DIN 51562 T01 | [$mm^2/s$] | 100 | 100 |
| Consistency DIN ISO 2137 | [0.1 mm] | 315 | 265 |
| Flow pressure at −40 °C DIN 51805-2 | [mbar] | 550 | 400 |
| Evaporation loss according to DIN 58397 at 140 °C, 168 h | % | 24 | 12 |
| Change in shear viscosity according to DIN 53019-1, CP25-1/TG, D = 0.052 mm, $\dot{\gamma}$ = 300 [1/s], T = 25 °C, after carrying out the evaporation loss according to DIN 58397 at 140 °C, 168 h | % | >>50%, no longer reliably determinable | −34% |

It is found that the lithium soap grease 11 according to the present disclosure has an improved low-temperature behavior in comparison with the Al complex soap grease 10. With comparable base oil composition and content, a lower flow pressure value according to DIN 51805-2 is observed for the lithium grease, although it has a firmer consistency. In addition, a smaller change in the shear viscosity of the grease 11 according to the present disclosure can be seen in comparison with comparative grease 10 after storage at 140 °C. Also shown again is the improved thickening effect of the lithium soap thickener at the same content in comparison with the aluminum complex thickener.

While subject matter of the present disclosure has been described in detail in the foregoing description, such descriptions are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for lubricating a work tool, comprising:

providing a lubricant composition, the lubricant composition comprising:

72 wt. % to 95 wt. % polyalphaolefin, and 5 wt. % to 26 wt. % lithium soap, each in relation to a total weight of the lubricant composition; and lubricating the work tool with the lubricant composition, the work tool being used to process, package, produce, portion, select, assemble, store, obtain and/or convey foodstuffs, cosmetics, cigarettes, pharmaceuticals and/or feedstuffs, wherein a content of metallocene-catalyzed polyalphaolefin is at least 10 wt. % in relation to the total weight of the lubricant composition, and/or wherein a content of acid-catalyzed polyalphaolefin is at least 10 wt. % in relation to the total weight of the lubricant composition;

wherein a content of co-thickener is from 0 wt % to 5 wt. % in relation to the total weight of the lubricant composition; and wherein the lubricant composition contains from 0.5 wt. % to 23 wt. %, polyisobutylene in relation to the total weight of the lubricant composition.

2. The method according to claim 1, wherein the lubricant composition is NSF/H1 compatible.

3. The method according to claim 1, wherein the polyalphaolefin is a polyalphaolefin produced from a-olefins selected from 1-octene, 1-nonene, 1-decene, 1-dodecene, 1-tridecene, 1-tetradecene and mixtures thereof.

4. The method according to claim 1, wherein the content of polyalphaolefin is at least 73 wt. % in relation to the total weight of the lubricant composition.

5. The method according to claim 1, wherein the polyalphaolefin has a viscosity, measured according to ASTM D7042-21 at 100 °C of 4 $mm_2/s$ to 350 $mm^2/s$ and/or wherein the polyalphaolefin has a pour point measured according to ASTM D5950 2014-07 of at most-20 °C.

6. The method according to claim 1, wherein the lubricant composition comprises at least one further base oil selected from the group consisting of esters, ethers, polyethers, phenyl ethers, perfluoropolyethers, mineral oils, white oils, synthetic hydrocarbons which do not belong to the class of polyalphaolefins, alkylated naphthalenes, copolymers of unsaturated hydrocarbons, polymers of ethylene and alphaolefins, natural hydrocarbons, native oils and derivatives of native oils, silicone oils, and mixtures thereof, and wherein the further base oils are NSF/H1 compatible.

7. The method according to claim 1, wherein the lubricant composition comprises at least one further base oil selected from the group consisting of esters, ethers, polyethers, synthetic hydrocarbons, white oils, perfluoropolyethers, alkylated naphthalenes and mixtures thereof, and wherein the at least one base oil is NSF/H1 compatible.

8. The method according to claim 6, wherein a proportion of the further base oil in the lubricant composition is from 4 to 23 wt. % in relation to the total weight of the lubricant composition.

9. The method according to claim 1, wherein a proportion of lithium soap in the lubricant composition is 5 wt. % to 18 wt. % in relation to the total weight of the lubricant composition.

10. The method according to claim 1, wherein the lubricant composition contains a simple lithium soap, produced from C4-C24 monocarboxylic acid, 12-hydroxystearic acid, salicylic acid, methyl esters and/or triglycerides of one or more of the aforementioned acids, sebacic acid monostearylamide, terephthalic acid monostearylamide and mixtures thereof.

11. The method according to claim 1, wherein the lubricant composition contains a simple lithium soap produced from mixtures of 12-hydroxystearic acid and/or the esters thereof, and stearic acid and/or the esters thereof.

12. The method according to claim 1, wherein the lubricant composition contains a lithium complex soap, produced from C4-C36 dicarboxylic acidsand/or from higher-functional carboxylic acids with 3 or more carboxylic acid groups, wherein a number of carbon atoms can be 6 to 60 and/or from methyl esters and/or triglycerides of one or more of the aforementioned acids, each combined with:

one or more monocarboxylic acids, and/or one or more C4-C24 monocarboxylic acids, stearic acid, 12-hydroxystearic acid, salicylic acid, or methyl esters, and/or triglycerides of one or more of the aforementioned acids, and/or sebacic acid monostearylamide and/or terephthalic acid monostearylamide.

13. The method according to claim 1, wherein the polyisobutylene is hydrogenated polyisobutylene.

14. The method according to claim 1, wherein the lubricant composition contains from 0.5 wt. % to 10 wt. % polyisobutylene in relation to the total weight of the lubricant composition.

15. The method according to claim 14, wherein the polyisobutylene has a number-average molecular weight of 115 to 10,000 g/mol determined by DIN 55672-1:2016-03.

16. The method according to claim 1, wherein the lubricant composition contains a solid lubricant selected from the group consisting of disodium sebacate, polytetrafluoroethylene (PTFE), hexagonal boron nitride, calcium carbonate and/or calcium pyrophosphate.

17. The method according to claim 16, wherein a proportion of solid lubricant in the lubricant composition is 0.5 wt. % to 23 wt. % in relation to the total weight of the lubricant composition.

18. The method according to claim 1, wherein the lubricant composition comprises:

36 wt. % to 55 wt. % acid-catalyzed polyalphaolefin, 36 wt. % to 55 wt. % metallocene-catalyzed polyalphaolefin, 1 wt. % to 15 wt. % polyisobutylene, 5 wt. % to 15 wt. % lithium soap, 1 wt. % to 10 wt. % solid lubricant, and 0.5 wt. % to 7 wt. % additives, each in relation to the total weight of the lubricant composition.

19. The method according to claim 1, wherein the lubricant composition comprises:

36 wt. % to 45 wt. % acid-catalyzed polyalphaolefin, 36 wt. % to 45 wt. % metallocene-catalyzed poly alphaolefin, 4 wt. % to 8 wt. % polyisobutylene, 5 wt. % to 10 wt. % lithium soap, 1 wt. % to 4 wt. % solid lubricant, and 1 wt. % to 3 wt. % additives, each in relation to the total weight of the lubricant composition.

20. The method according to claim 1, wherein the lubricant composition comprises less than 0.1 wt. % boric acid and boric acid derivatives in relation to the total weight of the lubricant composition.

21. The method according to claim 1, wherein lubricating the work tool comprises lubricating tribologically stressed components of the work tool.

22. The method according to claim 1, wherein lubricating the work tool comprises lubricating packaging machines for foodstuffs, cosmetics, cigarettes and/or lubricating transport chains and/or control chains.

* * * * *